US009005430B2

(12) United States Patent
Fournier et al.

(10) Patent No.: US 9,005,430 B2
(45) Date of Patent: Apr. 14, 2015

(54) PROCESS AND APPARATUS FOR INTEGRATION OF A HIGH-PRESSURE HYDROCONVERSION PROCESS AND A MEDIUM-PRESSURE MIDDLE DISTILLATE HYDROTREATMENT PROCESS, WHEREBY THE TWO PROCESSES ARE INDEPENDENT

(75) Inventors: Antoine Fournier, Houston, TX (US); Jean Luc Nocca, Houston, TX (US)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 1011 days.

(21) Appl. No.: 12/635,466

(22) Filed: Dec. 10, 2009

(65) Prior Publication Data

US 2011/0139680 A1 Jun. 16, 2011

(51) Int. Cl.

| | |
|---|---|
| ***C10G 69/14*** | (2006.01) |
| ***C10G 49/00*** | (2006.01) |
| ***C10G 49/16*** | (2006.01) |
| ***C10G 65/12*** | (2006.01) |

(52) U.S. Cl.

CPC ..... *C10G 49/007* (2013.01); *C10G 49/16* (2013.01); *C10G 65/12* (2013.01); *C10G 2300/4081* (2013.01); *C10G 2300/1044* (2013.01); *C10G 2300/1051* (2013.01); *C10G 2300/1055* (2013.01); *C10G 2300/1059* (2013.01); *C10G 2300/301* (2013.01); *C10G 2300/4012* (2013.01); *C10G 2300/42* (2013.01)

(58) Field of Classification Search

CPC ..... C10G 65/14; C10G 65/00; C10G 65/02; C10G 65/04; C10G 65/12; C10G 65/16; C10G 69/00; C10G 69/02; C10G 69/04; C10G 2300/4081; C10G 2300/42

USPC ..... 208/49, 87, 78, 208 R, 209, 106–108, 208/111.05, 111.3, 113, 120.05, 120.3

See application file for complete search history.

(56) References Cited

U.S. PATENT DOCUMENTS

| | | | | |
|---|---|---|---|---|
| 3,105,811 | A * | 10/1963 | Engel | 208/60 |
| 4,551,328 | A * | 11/1985 | Erben et al. | 423/607 |
| 5,403,469 | A * | 4/1995 | Vauk et al. | 208/78 |
| 6,190,533 | B1 * | 2/2001 | Bradow et al. | 208/57 |
| 6,514,403 | B1 * | 2/2003 | Louie et al. | 208/58 |
| 2007/0209965 | A1 * | 9/2007 | Duddy et al. | 208/57 |

* cited by examiner

*Primary Examiner* — Michelle Stein

(74) *Attorney, Agent, or Firm* — Millen, White, Zelano, Branigan, P.C.

(57) ABSTRACT

The invention relates to the integration of a process for hydrotreatment of distillates (light and/or middle), that operates under a hydrogen partial pressure of 0.5 to 6.0 MPa, with a process for hydrotreatment/hydroconversion of middle and/or heavy distillates that operates at a hydrogen partial pressure that is at least 4.0 MPa higher than the hydrogen partial pressure of the process for hydrotreatment of distillates (light and/or middle). The integration resides in the use of the hydrogen-rich gas, obtained from the hydrotreatment/hydroconversion effluents, in the process for hydrotreatment of distillates (light and/or middle) and in the adjustment of the pressure level of this hydrogen-rich gas removed from the hydrotreatment/hydroconversion. This invention makes it possible to considerably reduce the net consumption of make-up hydrogen in the process for hydrotreatment of distillates (light and/or middle).

17 Claims, 1 Drawing Sheet

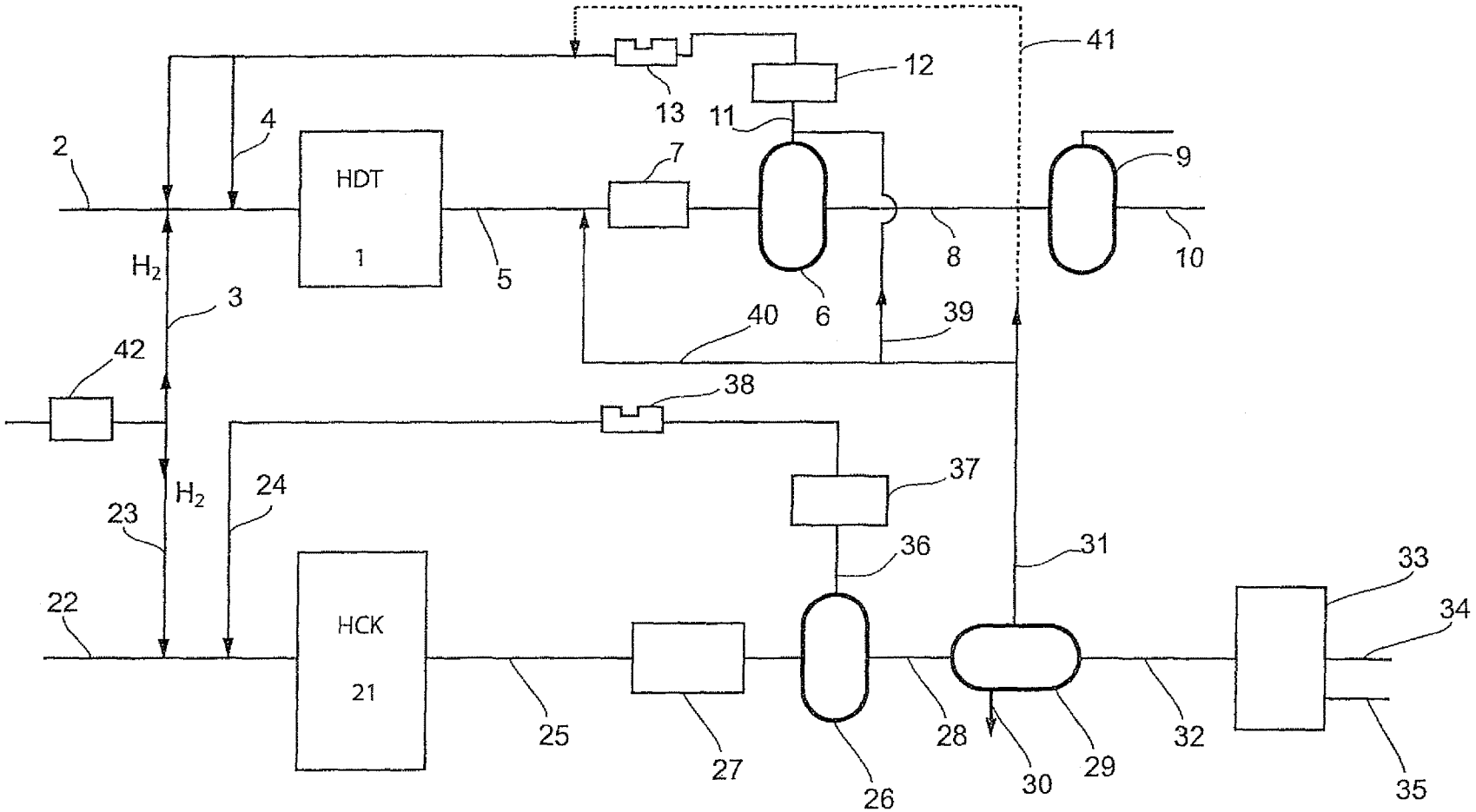
HDT
1
HCK
21
$H_2$
$H_2$
2
3
4
5
6
7
8
9
10
11
12
13
22
23
24
25
26
27
28
29
30
31
32
33
34
35
36
37
38
39
40
41
42

PROCESS AND APPARATUS FOR INTEGRATION OF A HIGH-PRESSURE HYDROCONVERSION PROCESS AND A MEDIUM-PRESSURE MIDDLE DISTILLATE HYDROTREATMENT PROCESS, WHEREBY THE TWO PROCESSES ARE INDEPENDENT

SUMMARY OF THE INVENTION

The invention relates to the integration of a process (unit) for hydrotreatment of light and/or middle distillates with low/medium pressure, operating under a hydrogen partial pressure of 0.5 to 6.0 MPa, with a process (unit) for hydrotreatment/hydroconversion of middle and/or heavy distillates with medium/high pressure, operating at a hydrogen partial pressure that is higher by at least 4.0 MPa than that of the process (unit) for hydrotreatment of light and/or middle distillates.

The integration resides in the use of hydrogen-rich gas, obtained from the hydrotreatment/hydroconversion effluents, in the process for hydrotreatment of light and/or middle distillates and in the adjustment of the pressure level of this hydrogen-rich gas. This invention makes it possible to considerably reduce the net consumption of make-up hydrogen of the process for hydrotreatment of distillates (light and/or middle).

The reaction sections (where the catalytic processes are implemented) of the two units are independent. As for the fractionation procedure (system), it can be common to both processes or it can be independent according to the needs and specifications of the required products.

The reaction sections of the units are to be independent, i.e., they are operated separately without one depending on the other. In other words, the medium/high-pressure hydrotreatment/hydroconversion process (or unit), on the one hand, and the low/medium-pressure light/middle distillate hydrotreatment process (or unit), on the other hand, are operated separately without depending on one another.

Dependent units (or processes) are, for example, a hydroconversion unit that produces middle distillates which are then sent to a hydrotreatment unit.

The term "light/middle distillate" refers to naphtha, kerosene and/or gas oil. The maximum boiling point for 95% by weight of this feedstock is 0 to 400° C. Preferably, the light/middle distillate is a coker naphtha.

The term "low/medium pressures" is intended to mean a hydrogen partial pressure of 0.5-6.0 MPa at the outlet of the reactor. These reactors are often units for hydrotreatment of naphtha and/or kerosene and/or gas oil (for example, gas oil for direct distillation of crude (straight-run) or coker naphtha).

The term "medium/high pressures" is intended to mean hydrogen partial pressures that are higher, by at least 4.0 MPa, than the hydrogen partial pressure of the low/medium-pressure unit. Thus, the "medium/high pressures" values are generally set 4.5-25.0 MPa.

These units that operate at medium/high pressure are, for example, units for the rigorous hydrotreatment of a diesel fraction (operating at a pressure of, e.g., 4.5-12.0 MPa), units for soft hydrocracking of VGO fractions (generally operating at a pressure of, e.g., 6.0-14.0 MPa), units for hydrocracking (most often operating at a pressure of, e.g., 9.0-17.0 MPa), process units for the treatment of heavier feedstocks in a fixed bed (such as the Hyvahl process), or process units for treatment of heavy feedstocks in a fluidized bed (such as the H-Oil process).

Such units are generally present on the refinery site and operate independently of one another, with their own supply of make-up hydrogen and their own recycling loop for hydrogen.

It has now been found that by using the medium-pressure hydrogen purge stream from the medium/high-pressure hydrotreatment/hydroconversion unit (often called hydroconversion below) to supply hydrogen to the hydrotreatment unit which treats light/middle distillate, and which is independent of the hydroconversion unit (often called hydrotreatment below), it is possible to significantly reduce (by up to 100%) the net make-up hydrogen requirements for hydrotreatment unit.

This implies that the operating conditions of the hydroconversion process is capable of providing for the recovery of a hydrogen-rich gas with a suitable pressure, and this requires a modification of the typical pressure level at the medium-pressure separator of the hydroconversion process.

Typically, hydroconversion units (hydrocracking, for example) operate with so-called "medium-pressure" separators wherein the total pressure is less than 2.0 MPa. The resultant medium-pressure purge stream from the medium-pressure separator is most often treated as a diesel fuel and therefore lost.

The process according to the invention therefore comprises a hydroconversion process (unit) that is carried out at a hydrogen partial pressure that is higher by at least 4 MPa than the hydrogen partial pressure of the hydrotreatment of the light/middle distillate. This hydroconversion process, using a medium-pressure separator, delivers an $H_2$-rich gas at a pressure of at least 2 MPa and ranging up to 8.0 MPa, and most often 2.2 to 8.0 MPa, especially 2.5-5.0 MPa.

More specifically, the invention relates to a process system comprising a process for hydrotreatment of a light/middle distillate, whose maximum boiling point for 95% by weight of the feedstock is 0-400° C., the hydrotreatment process operating a hydrogen partial pressure of 0.5-6.0 MPa and whose hydrogen supply is ensured at least partially by a hydrogen-rich gas obtained from separation(s) at 2-8 MPa of gases from an effluent of a hydrotreatment/hydroconversion process, the hydrotreatment/hydroconversion process operating at a hydrogen partial pressure that is higher by at least 4.0 MPa than the hydrogen partial pressure of the light/middle distillate hydrotreatment process.

In particular, the light-middle distillate hydrotreatment is a hydrotreatment of naphtha and/or kerosene and/or gas oil that operates under a hydrogen partial pressure of 0.5-6.0 MPa.

Advantageously, the hydrotreatment/hydroconversion process is carried out under a pressure of 4.5-25 MPa, preferably 6-25 MPa.

As mentioned above, the hydrotreatment/hydroconversion process is selected from the group comprising rigorous diesel fraction hydrotreatment at 4.5-12.0 MPa, soft hydrocracking of VGO fractions at 6.0-14.0 MPa, hydrocracking at 9.0-17.0 MPa, treatment of heavy feedstocks in a fixed bed, or treatment of heavy feedstocks in a fluidized bed.

Very advantageously, the light/middle distillate hydrotreatment is a naphtha and/or kerosene hydrotreatment that operates under a hydrogen partial pressure of 0.5-6.0 MPa, preferably 2-6 MPa, and the hydrotreatment/hydroconversion process is a hydrocracking process that at 9.0-17.0 MPa.

In the preferred case, the hydrotreatment of light/middle distillate, on the one hand, and hydrotreatment/hydroconversion, on the other hand, have their own recycling loop for hydrogen with compression.

The invention offers significant advantages, in particular in terms of make-up hydrogen consumption in hydrotreatment. These advantages are particularly advantageous within the scope of a coking process that comprises a unit for hydrocracking coker gas oil and a unit for hydrotreatment of the coker naphtha.

Coking is a process that makes it possible to upgrade heavy residues in terms of middle distillates (gas oil, naphtha, kerosene generally being treated with naphtha), and in terms of producing coke.

Herein the term "coker gas oil" is intended to mean a coker VGO (vacuum gas oil).

This gas oil, generally mixed with other gas oils, such as, for example, direct distillation vacuum gas oil (SRVGO), is generally hydrocracked before optionally being hydrotreated. The naphtha is directly hydrotreated and sent to catalytic reforming or directly to storage.

The coker naphtha offers high contents of nitrogen (most often 50-200 ppm by weight), and sulfur (most often 100-20, 000 ppm by weight), as well as olefins (40-60% by volume) and aromatic compounds (15-25% by volume). Consequently, the operating conditions are rigorous so as to carry out, in particular, an intense hydrodesulfurization and hydrodenitrification (sulfur and nitrogen contents generally of less than 1.0 ppm by weight or 0.5 ppm by weight to be obtained). The result is a relatively large addition of hydrogen to the process.

The reforming (catalytic or vapor) is generally the sole hydrogen-producing process and makes it possible to ensure the progress of the hydrotreatments and the hydrocracking device.

The gas that is used for the low/medium-pressure hydrotreatments generally contains 70-90% hydrogen whereas the high-pressure units, such as hydrocracking, require purities of at least 99% by volume.

The invention therefore proposes a simple means of managing hydrogen at these independent units and doing so while achieving unexpected savings. The process and the installation according to the invention, starting from the coking process, as well as the results that are obtained will be described in more detail.

Within this framework, the invention relates to a coker naphtha hydrotreatment process that is part of a process for coking petroleum waste that produces coke, coker naphtha, and coker gas oil, a process in which

- Said gas oil, alone or in a mixture, is subjected to hydrocracking at a hydrogen partial pressure of 9.0-17.0 MPa; the gases are separated from the hydrocracked effluent in a high-pressure separator at 30-70° C., and under 12.0-25.0 MPa, and then in a medium-pressure separator at 30-70° C. and 2.0-6.0 MPa, and the liquid effluent is fractionated,
- Said coker naphtha is subjected to a hydrotreatment at 150-400° C. and under a hydrogen partial pressure of 2.0-6.0 MPa,
- The hydrogen-rich gas obtained from the medium-pressure separator is introduced into the hydrotreatment of the coker naphtha.

This introduction is generally made upstream from the recycling compressor or optionally downstream from the recycling compressor.

Typically, the hydrotreatment of the coker naphtha is performed under a hydrogen partial pressure of 2 to 6 MPa.

Generally, at the end of the hydrotreatment of the coker naphtha, a hydrogen-rich gas is separated form the hydrotreated effluent in a separator, and it is optionally subjected to one or more purification treatment(s) before being compressed, and then is recycled to the hydrotreatment of the coker naphtha.

Generally, the purification treatment of the hydrogen-rich gas comprises washing with water and/or washing with amine (or with amines). According to the invention, the purification treatment is carried out on the hydrogen-rich gas obtained from the medium-pressure separator of the hydrocracking process and/or on the hydrogen-rich gas that is separated from the effluent from the hydrotreatment process.

Generally, the liquid effluent obtained from the separation of gases from the hydrotreated effluent is separated (for example, stripped) to obtain hydrotreated naphtha which can then be sent to catalytic reforming. The naphtha obtained according to the invention has characteristics that are particularly well suited to catalytic reforming. In some cases, the hydrotreated effluent can be sent directly to a fractionation unit of the hydrocracking unit.

As has already been indicated, the coker naphtha hydrotreatment, on the one hand, and the hydrocracking, on the other hand, have their own recycling loop for hydrogen with compression. Advantageously, the hydrocracking is fed only by make-up hydrogen and by the hydrogen that is recycled at high pressure. The coker naphtha hydrotreatment is fed by its recycling hydrogen, by the hydrogen-rich gas obtained from the medium-pressure separator of the hydrocracking process, and if necessary, by make-up hydrogen.

Preferably, the two units (where the processes of coker naphtha hydrotreatment, on the one hand, and hydrocracking, on the other hand, take place) utilize a common fractionation system.

Advantageously, these two units have a common system for compression of make-up hydrogen.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

The FIGURE illustrates a process embodiment according to the invention.

DETAILED DESCRIPTION OF THE DRAWINGS

As shown in the FIGURE, feedstock enters the independent light/middle distillate hydrotreatment reactor unit (1) via the pipe (2). The make-up hydrogen is introduced into the hydrotreatment reactor unit (1) via the pipe (3), and recycled hydrogen is introduced into the hydrotreatment reactor unit (1) via the pipe (4). The feedstock, make-up hydrogen, and the recycled hydrogen are mixed before entering the reactor (1).

The feedstock to reactor (1) is a light/middle distillate (naphtha, kerosene and/or gas oil) whose maximum boiling point generally ranges from 0 to 400° C. Preferably, the feedstock to reactor (1) is a naphtha feedstock, especially a coker naphtha feedstock.

The feedstock to reactor (1) can be obtained from a single source or it can be a mixture, for example, a coker naphtha mixed with an external feedstock that is, for example, a straight-run naphtha.

The hydrotreatment reactor (1) contains a hydrotreatment catalyst.

Hydrotreatment catalysts are extensively described in the prior art.

Generally, a hydrotreatment catalyst that contains at least one element of group VIII (preferably Co, Ni) and/or at least one element of group VI (preferably Mo, W) deposited on an amorphous substrate is used for coker naphtha. A preferred catalyst is NiMo/alumina.

The operating conditions for hydrotreatment reactor (1) are: 250-420° C. (for a naphtha, preferably 250-350° C.), and an LHSV of 0.5 to 10 h-1. The hydrogen partial pressure is 0.5-6.0 MPa. Preferably for a naphtha (other than a coker naphtha), the hydrogen partial pressure is preferably 0.5-4 MPa. In the case of a coker naphtha (alone or in a mixture in particular with the straight-run naphtha), kerosene, or gas oil, the hydrogen partial pressure is preferably 2-6 MPa. In an advantageous embodiment, before being hydrotreated, the coker naphtha feedstock undergoes a selective hydrogenation of diolefins.

The hydrotreated effluent discharged from reactor (1) via the pipe (5) is cooled and then separated in a separator (6), after optional washing with water (washer 7). The liquid effluent obtained from separator (6) is sent, via the pipe (8), to a separation system (9), which generally comprises a stripper and optionally a distillation column. In the FIGURE, this system consists of a stripper. The resultant hydrotreated naphtha discharged from the separation system via pipe (10) has the necessary characteristics for being sent to catalytic reforming.

In some cases, the separation system can be common to two units, leading to a reduction in the cost.

The hydrogen-rich gas removed from separator (6) via pipe (11) enters the recycling loop for the light/middle distillate hydrotreatment unit where it optionally undergoes one or more purification treatment(s) (12), which are generally a washing with an amine (or with amines). Such washing processes are known and are described in the literature. The gas is generally compressed (compressor 13 in the FIGURE) before or after the washing (in particular before or after the washing with amine(s)) and recycled via pipe (4) to the light/middle distillate hydrotreatment reactor (1).

In the independent hydrotreatment/hydroconversion reactor unit (21), the feedstock is introduced into reactor (21) via pipe (22). Compressed make-up hydrogen (from compressor 42) is introduced into reactor (21) via pipe (23), and the recycled hydrogen is introduced via the pipe (24). The feedstock, make-up hydrogen, and recycled hydrogen are mixed before entering the reactor (21).

The feedstock to the hydrotreatment/hydroconversion reactor unit (21) is a heavy feedstock whose boiling point generally ranges from 150° C. to 800° C.

These feedstocks are, in general, vacuum distillation gas oils (VGO), obtained from the distillation of crude or conversion processes, for example, a coking process (coker gas oil). The feedstock can be obtained from a single source or it can be a mixture, for example, a coker gas oil mixed with an external feedstock that is, for example, a straight-run gas oil.

The reactor (21) contains a hydrotreatment and/or hydroconversion catalyst. Hydrotreatment and hydroconversion catalysts are extensively described in the prior art.

Generally, the hydrotreatment and/or hydroconversion catalyst contains at least one element of group VIII (preferably Co, Ni) and/or at least one element of the group VI (preferably Mo, W) deposited on an acidic amorphous substrate (such as silica-alumina) or zeolitic amorphous substrate is used for the coker gas oil. Preferred catalysts include NiMo/Y-alumina, CoMo/Y-alumina, NiMo/silica-alumina, CoMo/silica-alumina, NiW/silica-alumina, and GVIII-GVIB-type composites that are supported on silica-alumina+Y zeolite.

The hydrogen partial pressure in reactor (21) is at least 4 MPa higher than the hydrogen partial pressure of in the middle distillate hydrotreatment reactor (1). The pressures associated with the various hydrotreatment/hydroconversion processes are described above.

The reaction pressures and the medium-pressure separation (described below) are determined so that the medium-pressure separation produces a hydrogen-rich gas in an optimum quantity with a purity of 70%-99% for the middle-distillate hydrotreatment unit. The medium-pressure separation is thus carried out at 2-8 MPa.

The hydroconverted effluent (hydrocracked in the case where the unit (21) is a hydrocracking device) discharged from reactor (21) via pipe (25) is separated in a high-pressure separator (26), after optional washing with water in washer (27), to form a hydrogen-rich gas (pipe 36) and a liquid effluent. The liquid effluent obtained is sent via pipe (28) to a medium-pressure separator (29) where the liquid water (pipe 30) and a hydrogen-rich gas (pipe 31) are separated from the liquid effluent. The resultant liquid effluent is sent via pipe (32) to a separation system (33) that generally comprises a stripper and one or more distillation columns Middle distillates (for example, naphtha in pipe 34, gas oil in pipe 35) are obtained and are optionally hydrotreated before being sent into the corresponding fuel pool.

The hydrogen-rich gas removed from separator (26) via pipe (36) enters the recycling loop for the hydroconversion unit where it optionally undergoes one or more purification treatment(s) (37), for example, a washing with amine (or with amines). These purification treatments are described in the literature. If necessary, the hydrogen-rich gas is compressed (compressor 38 in the FIGURE), before or after the washing (in particular before or after the amine washing) and recycled via pipe (24) to the hydroconversion unit (21).

The hydrogen-rich gas removed from the medium-pressure separator (29) via pipe (31) is sent to the recycling loop (pipe 11) for the middle distillate hydrotreatment unit. This hydrogen-rich gas can be introduced at a point upstream from the compressor (13), via pipe 39, or downstream from the compressor (13), via pipe (41) and/or into the hydrotreated effluent (pipe 5), via pipe (40).

Advantageously, the introduction of this hydrogen-rich gas into the recycling loop (pipe 11) takes place directly without prior treatment, whereby treatment(s) can be carried out on the independent middle distillate hydrotreatment unit that has, if necessary, suitable equipment for the purification treatment(s).

Thus, when the hydrogen-rich gas is injected into the hydrotreated effluent (5), it is advantageous to do introduce the hydrogen-rich gas at the washer (7) so that it undergoes washing with water, when washer (7) is present. Similarly, when the hydrogen-rich gas is introduced into the hydrogen recycling loop for the middle distillate hydrotreatment unit, it is advantageously introduced before the purification treatment (12), when purification treatment (12) is present.

Advantageously, the introduction takes place directly without prior compression, whereby the pressure level of the pipe (31) is consequently adjusted.

Furthermore, it is also possible to provide only a single separation system (for example, not a stripper on the middle distillate hydrotreatment, in particular coker naphtha, but a transfer of the liquid effluent from pipe (8) to the stripper of the separation system (33) of the liquid effluent obtained from the hydroconversion unit (21) or a common part of the separation system (for example, common distillation column, separate strippers) for the two independent units (1) and (21).

Furthermore, it is advantageous to use the first stage of the make-up hydrogen compressor of the high-pressure unit (hydrocracking device of the coker gas oil, for example) to complete, if necessary, the demand for hydrogen of the light/middle distillate hydrotreatment (in particular the coker naphtha).

Thus, this process is simple to implement, particularly in existing installations, and offers a solution for improving the management of the hydrogen on the site of the refinery. It allows significant gains in make-up hydrogen (up to 100%) for the light/middle distillate hydrotreatment, and a better use of the hydrogen of the high-pressure unit.

In addition, while allowing the independent operation of the units, the process makes it possible to use the make-up compressor of the middle/high pressure unit for ensuring the make-up of hydrogen of the low/middle-pressure unit. if necessary.

It therefore proves to be economically advantageous, especially since it does not require a costly investment (no additional compressor).

The flexibility of the independent units is preserved. Thus, it is possible to operate the high-pressure unit when the hydrotreatment unit upon shutdown. Conversely, it is possible to operate the hydrotreatment unit when the high-pressure unit is stopped.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

We claim:

1. A process for hydrotreatment of a light/middle distillate having a boiling point for 95% by weight of the feedstock of 0-400° C., said process comprising:

hydrotreating said light/middle distillate feedstock in a light/middle distillate hydrotreatment unit operating under a hydrogen partial pressure of 0.5-6.0 MPa, to which hydrogen is supplied, wherein the hydrogen supplied to the a light/middle distillate hydrotreatment unit is at least partially a hydrogen-rich gas obtained from the separation of gases from an effluent from a hydrotreatment and/or hydroconversion unit, the latter unit being independent from said hydrotreatment unit, wherein said hydrogen-rich gas obtained from separation of gases from said effluent from said hydrotreatment and/or hydroconversion unit is introduced into said hydrotreatment unit without prior compression and without prior treatment, and wherein said separation of gases is conducted at 2-8 MPa, and the hydrotreatment and/or hydroconversion is conducted in said hydrotreatment and/or hydroconversion unit on a feedstock having a higher boiling point than said light/middle distillate and is carried out at a hydrogen partial pressure that is at least 4.0 MPa higher than the operating hydrogen partial pressure of the light/middle distillate hydrotreatment unit.

2. A process according to claim 1, wherein the light/middle distillate hydrotreatment is a hydrotreatment of a naphtha and/or kerosene and/or gas oil feedstock performed at a hydrogen partial pressure of 0.5-6 MPa.

3. A process according to claim 1, wherein the hydrotreatment and/or hydroconversion is carried out at a pressure of 4.5-25 MPa.

4. A process according to claim 3, wherein the hydrotreatment and/or hydroconversion is carried out at a pressure of 6-25 MPa.

5. A process according to claim 1, wherein the hydrotreatment and/or hydroconversion comprises any of: a diesel fraction hydrotreatment at 4.5-12.0 MPa; hydrocracking of VGO fractions at 6.0-14.0 MPa; hydrocracking at 9.0-17.0 MPa; treatment of heavy feedstocks in a fixed bed; or treatment of heavy feedstocks in a fluidized bed.

6. A process according to claim 1, wherein the light/middle distillate hydrotreatment comprises hydrotreatment of a naphtha and/or kerosene feedstock, the hydrotreatment being conducted at a hydrogen partial pressure of 0.5-6 MPa, and the hydrotreatment and/or hydroconversion comprises a hydrocracking process conducted at 9.0-17.0 MPa.

7. A process according to claim 6, wherein the light/middle distillate hydrotreatment is conducted at a hydrogen partial pressure of 2-6 MPa.

8. A process according to claim 1, wherein the light/middle distillate hydrotreatment feedstock is naphtha, which is not a coker naphtha, and the light/middle distillate hydrotreatment is conducted at a hydrogen partial pressure of 0.5-4.0 MPa.

9. A process according to claim 1, wherein the light/middle distillate hydrotreatment includes a recycling loop with compression for recycling hydrogen, and the hydrotreatment and/or hydroconversion also includes a separate recycling loop with compression for recycling hydrogen.

10. A process according to claim 1, in which the separation of gases is performed at 2.2-8 MPa.

11. A process according to claim 1, in which the separation of gases is performed at 2.5-5 MPa.

12. A process for hydrotreatment of naphtha according to claim 2, wherein the naphtha is coker naphtha and wherein the hydrotreatment of said coker naphtha is part of a process for coking petroleum residues that produces coke, coker naphtha, and coker gas oil, and the overall process comprises:

subjecting coker gas oil to hydrocracking at a hydrogen partial pressure of 9.0-17.0 MPa to produce a hydrocracked effluent;

separating gases from the hydrocracked effluent in a high-pressure separator at 30-70° C. and under 12.0-25.0 MPa, and then in a medium-pressure separator at 30-70° C. and 2.0-8.0 MPa, and fractionating the resultant liquid effluent, and separately subjecting the coker naphtha to hydrotreatment at 150-400° C. and under a hydrogen partial pressure of 2.0-6.0 MPa, and introducing hydrogen-rich gas obtained from said medium-pressure separator into the hydrotreatment of the coker naphtha.

13. A process according to claim 12, wherein after the hydrotreatment of coker naphtha, a hydrogen-rich gas is separated from the resultant hydrotreated effluent in a separator and is optionally subjected to one or more purification treatment(s) before optionally being compressed, and recycled to the coker naphtha hydrotreatment.

14. A process according to claim 12, further comprising purification treatment(s) comprising a washing with water and/or a washing with amine(s), and wherein said purification treatment(s) is performed on hydrogen-rich gas separated from the hydrotreated effluent.

15. A process according to claim 12, wherein the hydrotreatment of coker naphtha includes a recycling loop with compression for recycling hydrogen, and the hydrocracking of the coker gas oil also includes a separate recycling loop with compression for recycling hydrogen.

16. A process according to claim 12, wherein the effluents of the coker naphtha hydrotreatment and the coker gas oil hydrocracking processes are treated in a common fractionation system.

17. A process according to claim 12, wherein the coker naphtha hydrotreatment and the coker gas oil hydrotreatment/hydrocracking processes have a common system for compression of make-up hydrogen.

* * * * *